US010290276B2

(12) United States Patent
Lv

(10) Patent No.: US 10,290,276 B2
(45) Date of Patent: May 14, 2019

(54) GOA DRIVE CIRCUIT

(71) Applicant: Shenzhen China Star Optoelectronics Technology Co., Ltd., Shenzhen, Guangdong (CN)

(72) Inventor: Xiaowen Lv, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 93 days.

(21) Appl. No.: 15/539,733

(22) PCT Filed: May 8, 2017

(86) PCT No.: PCT/CN2017/083452

§ 371 (c)(1),
(2) Date: Jun. 26, 2017

(87) PCT Pub. No.: WO2018/184271

PCT Pub. Date: Oct. 11, 2018

(65) Prior Publication Data

US 2018/0293950 A1 Oct. 11, 2018

(30) Foreign Application Priority Data

Apr. 7, 2017 (CN) ..... 2017 1 0224687

(51) Int. Cl.
*G09G 3/36* (2006.01)
*G09G 3/20* (2006.01)

(52) U.S. Cl.
CPC ..... *G09G 3/3677* (2013.01); *G09G 3/20* (2013.01); *G09G 2300/0408* (2013.01); *G09G 2300/0842* (2013.01); *G09G 2310/0267* (2013.01); *G09G 2310/0286* (2013.01)

(58) Field of Classification Search
CPC ..... G09G 3/3677; G09G 2300/0408; G09G 2300/0842
See application file for complete search history.

(56) References Cited

U.S. PATENT DOCUMENTS

2016/0284293 A1* 9/2016 Dai ..... G09G 3/36

* cited by examiner

*Primary Examiner* — Aneeta Yodichkas

(57) ABSTRACT

Disclosed is a GOA drive circuit, which includes multiple stages of GOA drive units. A pull-down unit of a GOA drive unit in each stage is configured to increase a time for a first voltage signal to be pulled down to a first electric potential during a process when the first voltage signal jumps from a high electric potential to a low electric potential, so as to enable the first voltage signal to have a stepwise falling edge. In the GOA drive circuit, smoothness of a voltage at a key node thereof during a voltage changing process can be ensured, whereby an output performance of the GOA drive circuit can be improved, and an overall performance thereof can be improved accordingly.

14 Claims, 2 Drawing Sheets

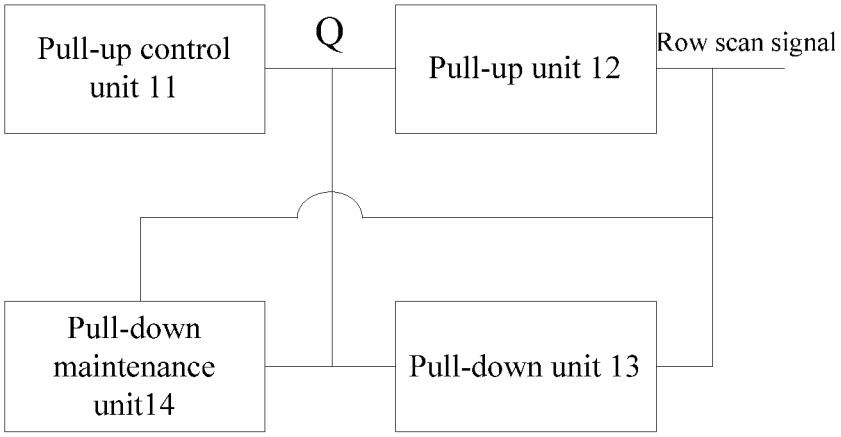
Fig. 1 (Prior art)
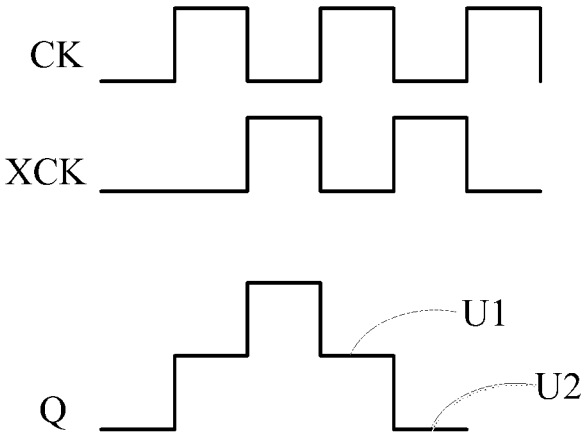
Fig. 2

GOA DRIVE CIRCUIT

CROSS-REFERENCE TO RELATED APPLICATIONS

This application claims the priority of Chinese patent application CN201710224687.0, entitled "GOA drive circuit" and filed on Apr. 7, 2017, the entirety of which is incorporated herein by reference.

FIELD OF THE INVENTION

The present disclosure relates to the technical field of display, and in particular, relates to a GOA drive circuit.

BACKGROUND OF THE INVENTION

With the development of the liquid crystal display technology and the improvement of the performance of thin film transistor (TFT), gate on array (GOA) drive circuit has been widely applied to liquid crystal display devices.

A GOA drive circuit has many advantages. For example, since the GOA drive circuit is formed on an array substrate directly, using amount of a gate integrated circuit (Gate IC) chip can be saved, and design of a frameless display screen can be realized. Moreover, when the GOA drive circuit is used, a qualified rate of the display screen can be improved, and a production cost thereof can be reduced.

In order to improve a performance of the GOA drive circuit, it is an important means to keep a voltage at a key circuit node in the GOA drive circuit stable.

SUMMARY OF THE INVENTION

One technical problem to be solved by the present disclosure is how to provide a GOA drive circuit which enables a voltage at a key circuit node thereof to be stable.

In order to solve the above technical problem, an embodiment of the present application provides a GOA drive circuit. The GOA drive circuit comprises multiple stages of GOA drive units, and a GOA drive unit in each stage is used for outputting a row scan signal to a row of pixel units. The GOA drive circuit comprises a pull-up unit, a pull-up control unit, a transmission unit, a pull-down unit, and a pull-down maintenance unit. The pull-up control unit outputs a first voltage signal. The pull-down unit is configured to increase a time for the first voltage signal to be pulled down to a first electric potential during a process when the first voltage signal jumps from a high electric potential to a low electric potential, so as to enable the first voltage signal to have a stepwise falling edge.

Preferably, a delay element is disposed on a path where the first voltage signal discharges by means of the pull-down unit.

Preferably, the pull-down unit comprises a first transistor. A gate of the first transistor is connected to a pull-down signal. A drain of the first transistor is connected to the first voltage signal. A source of the first transistor is connected to a first end of the delay element. A second end of the delay element is connected to a first power signal.

Preferably, the delay element comprises a second transistor. A gate and a drain of the second transistor are both connected to the source of the first transistor. A source of the second transistor is connected to the first power signal.

Preferably, the pull-down unit further comprises a third transistor. A gate of the third transistor is connected to the pull-down signal. A drain of the third transistor is connected to the row scan signal corresponding to the GOA drive unit to which the drain belongs. A source of the third transistor is connected to the first power signal.

Preferably, the pull-up control unit comprises a fourth transistor. A gate of the fourth transistor is connected to a transmission signal output by a transmission unit of a GOA drive unit in a previous stage in cascade connection with the GOA drive unit in a present stage. A source of the fourth transistor is connected to the first voltage signal. A drain of the fourth transistor is connected to a second power signal.

Preferably, the pull-down maintenance unit comprises a fifth transistor. A source of the fifth transistor is connected to the first power signal, and a drain of the fifth transistor is connected to the first voltage signal. The pull-down maintenance unit further comprises a sixth transistor. A gate and a source of the sixth transistor are respectively connected to a gate and the source of the fifth transistor, and a drain of the sixth transistor is connected to the row scan signal corresponding to the GOA drive unit to which the drain belongs. The pull-down maintenance unit further comprises a seventh transistor. A source of the seventh transistor is connected to the first power signal. A gate of the seventh transistor is connected to the first voltage signal. A drain of the seventh transistor is connected to the gate of the fifth transistor. The pull-down maintenance unit further comprises an eighth transistor. A gate and a drain of the eighth transistor are both connected to a third power signal, and a source of the eighth transistor is connected to the gate of the fifth transistor.

Preferably, the pull-up unit comprises a ninth transistor. A gate of the ninth transistor is connected to the first voltage signal. A drain of the ninth transistor is connected to a clock signal. A source of the ninth transistor is connected to the row scan signal corresponding to the GOA drive unit to which the source belongs. The pull-up unit further comprises a bootstrap capacitor. The bootstrap capacitor is in parallel connection between the gate and the source of the ninth transistor.

Preferably, the pull-down signal comprises a row scan signal output by a GOA drive unit in a next stage in cascade connection with the GOA drive circuit in the present stage.

Preferably, a duty ratio of the clock signal is 0.5.

Compared with the prior art, one embodiment or a plurality of embodiments according to the present disclosure may have the following advantages or beneficial effects.

Smoothness of a voltage at a key node in a circuit in a changing process is ensured by disposing a delay element within a pull-down unit so as to increase a time for a voltage at a node Q to be pulled down to a first electric potential so as to enable the voltage at the node Q to have a stepwise falling edge. An output performance of a GOA drive circuit can be improved, and an overall performance thereof can be improved accordingly.

Other advantages, objectives and features of the present disclosure will be further explained in the following description, and will partly become self-evident based on a study of the following text, or teachings can be obtained through an implementation of the present disclosure. The objectives and other advantages of the present disclosure will be achieved through structures specifically pointed out in the description, claims, and accompanying drawings.

BRIEF DESCRIPTION OF THE DRAWINGS

The accompanying drawings provide further understandings of the present disclosure or the prior art, and constitute one part of the description. The drawings are used for interpreting the present disclosure together with the embodiments, not for limiting the present disclosure. In the drawings:

FIG. 1 schematically shows a structure of a GOA drive unit in the prior art;

FIG. 2 schematically shows a waveform of a voltage at a node Q; and

DETAILED DESCRIPTION OF THE EMBODIMENTS

Figure 3:
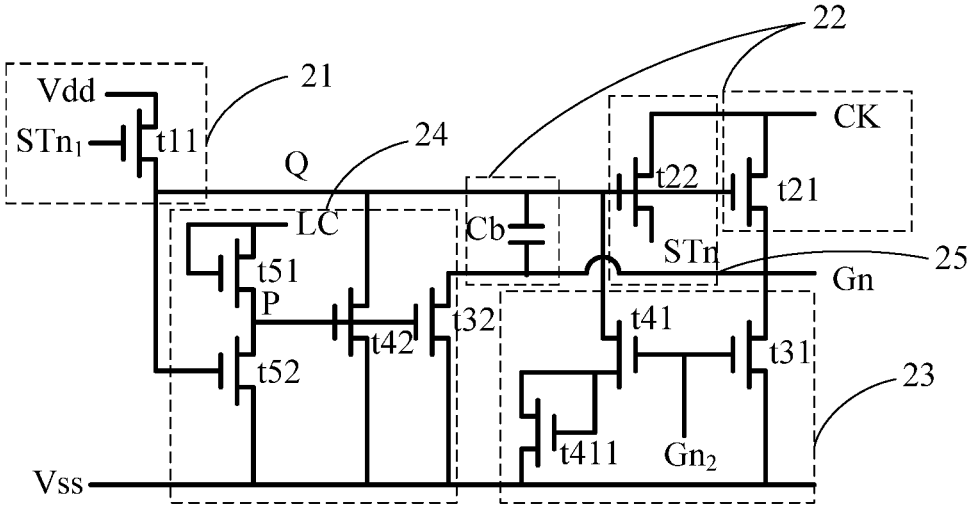
FIG. 3 schematically shows a structure of a GOA drive unit in a stage according to an embodiment of the present disclosure.

The implementation manner of the present disclosure will be explained in detail below with reference to the embodiments and the accompanying drawings, so that one can fully understand how the present disclosure solves the technical problem and achieves the technical effects through technical means, thereby implementing the same. It should be noted that as long as there is no structural conflict, any of the embodiments of the present disclosure and any of the technical features of the embodiments may be combined with one another, and the technical solutions obtained therefrom all fall within the scope of the present disclosure.

FIG. 1 schematically shows a structure of a GOA drive unit in the prior art. An actual GOA drive circuit is generally comprised of multiple stages of interconnected GOA drive units as shown in FIG. 1. A GOA drive unit in a stage is used for outputting a row scan signal to a row of pixel units.

As shown in FIG. 1, the GOA drive unit in the prior art generally comprises a pull-up control unit 11, a pull-up unit 12, a pull-down unit 13, and a pull-down maintenance unit 14. The pull-up control unit 11 is connected to the pull-up unit 12, and can output a control signal to the pull-up unit 12 in a specific time sequence. The control signal is represented by a voltage at a node Q, and the control signal is used for turning on the pull-up unit 12 so that the pull-up unit 12 outputs a row scan signal. The pull-down unit 13 is used for pulling down the row scan signal of the GOA drive unit in a present stage and the voltage at the node Q to a low electric potential. The pull-down maintenance unit 14 is used for maintaining the row scan signal and the voltage at the node Q to be at a low electric potential during a non-scan period of a present row of pixel units.

It can be seen that, the node Q is a junction of many branches, and is a key circuit node in the GOA drive circuit. Whether a voltage value and the time sequence of actions of the node Q meet requirements is critical for realization of functions of the GOA drive circuit. Moreover, in actual use, when the voltage at the node Q changes, including changing from a high electric potential to a low electric potential or from a low electric potential to a high electric potential, smoothness of the voltage at the node Q can also have a great influence on a performance of the GOA drive circuit. Generally, a waveform of the voltage at the node Q is required to show a stepwise change. The reason is that, instantaneous variation amount of the voltage at the node Q is very large if the voltage at the node Q is directly pulled down to a preset final low electric potential, and a surge voltage or a surge current generated therein would weaken an output performance of the GOA drive circuit.

The waveform of the voltage at the node Q is shown in FIG. 2. CK and XCK respectively represent clock signals input to the GOA drive circuit. The waveform of the voltage at the node Q stepwise changes in both a rising edge and a falling edge. U1 and U2 respectively represent preset voltage values at which waveforms of the voltage at the node Q are in different levels of steps. When the voltage at the node Q changes from a high electric potential to a low electric potential, U1 represents a first-step electric potential reached in a first change, and U2 represents a second-step electric potential reached in a second change. The present disclosure mainly provides a solution to form a stepwise falling edge with two steps when the voltage at the node Q changes from a high electric potential to a low electric potential. The present disclosure will be described below with reference to a specific embodiment.

A structure of the GOA drive unit according to an embodiment of the present disclosure is shown in FIG. 3. The GOA drive unit comprises a pull-up control unit 21, a pull-up unit 22, a pull-down unit 23, a pull-down maintenance unit 24 and a transmission unit 25. The pull-down unit 23 is configured to increase a time for a voltage at a node Q to be pulled down to a preset first-step electric potential (a first electric potential) during a process when the voltage at the node Q jumps from a high electric potential to a low electric potential.

According to one embodiment of the present disclosure, a delay element is disposed on a path where the voltage of the node Q discharges by means of the pull-down unit 23. The time for the voltage at the node Q to change is increased by a delay effect generated by the delay element, and meanwhile the voltage at the node Q can reach the preset first-step electric potential after a first change.

Specifically, as shown in FIG. 3, a transistor t11 (a fourth transistor) forms the pull-up control unit 21. A gate of the transistor t11 is connected to a transmission signal $STn_1$ ($n_1$ is smaller than n) output by a GOA drive unit in a previous stage which is in cascade connection with the GOA drive unit in a present stage. A source of the transistor t11 is connected to the node Q. A drain of the transistor t11 is connected to a constant high voltage signal Vdd (a second power signal). The transmission signal $STn_1$ is generated by a transmission unit 25 in a GOA drive circuit in an $n_1$ stage.

The transmission unit 25 mainly comprises a transistor t22. A gate of the transistor t22 is connected to the node Q. A drain of the transistor t22 is connected to a clock signal CK. A source of the transistor t22 outputs a transmission signal STn (corresponding to a transmission signal of the GOA drive unit in the present stage). According to the embodiment of the present disclosure, since the transmission unit 25 is arranged, electric leakage at the node Q of the GOA drive unit in the present stage at a voltage maintenance phase via the pull-up unit 22 can be reduced.

The pull-up unit 22 comprises a transistor t21 (a ninth transistor) and a bootstrap capacitor Cb. The bootstrap capacitor Cb is in parallel connection between a gate and a source of the transistor t21. A drain of the transistor t21 is connected to the clock signal CK. A source of the transistor t21, which serves as a row scan signal output end of the GOA drive unit in the present stage, outputs a corresponding row scan signal Gn. A gate of the transistor t21 is connected to the node Q.

According to the present embodiment, the pull-down unit 23 comprises a transistor t31 (a third transistor), a transistor t41 (a first transistor) and a transistor t411 (a second transistor). A gate of the transistor t31 and a gate of the transistor t41 are connected together to receive control of a pull-down signal. A drain of the transistor t31 is connected to the row scan signal of the GOA drive unit in the present stage, and is used for pulling down the corresponding row scan signal. A source of the transistor t31 is connected to a constant low voltage signal Vss (a first power signal).

A drain of the transistor t41 is connected to the node Q, and a source thereof is connected to a gate of the transistor t411. A drain and the gate of the transistor t411 are connected together, and meanwhile they are connected to the source of the transistor t41. The transistor t411 can realize a delay function of the delay element. The drain and the gate which are connected together correspond to a first end of the delay element. A source of the transistor t411 corresponds to a second end of the delay element, and the second end is connected to the constant low voltage signal Vss.

The gate of the transistor t31 and the gate of the transistor t41 are controlled by a pull-down signal $Gn_2$ ($Gn_2$ is a row scan signal corresponding to a GOA drive unit in an $n_2$ stage, and $n_2$ is larger than n).

A working process of the abovementioned pull-down unit 23 is stated as follows. When the pull-down signal $Gn_2$ is at a high level, the transistor t31 will be turned on first to pull down the row scan signal Gn of the GOA drive unit in the present stage to a low electric potential. However, there is a pull-down delay in a branch where the transistor t41 and the transistor t411 are located due to an effect of the transistor t411. Specifically, when the gate of the transistor t41 is applied to a high-level signal, an electric potential of the gate of the transistor t411, which is connected to the source of the t41, will also gradually rise. However, in an initial stage, the transistor t411 is not turned on. When the electric potential rises to a certain value, the transistor t411 is turned on, and the transistor t41 is connected to the constant low voltage signal Vss via the transistor t411. At this time, a discharging path constituted by the transistor t41 and the transistor t411 are formed entirely, and the node Q begins to discharge.

As can be seen, since the transistor t411 is disposed on the discharging path of the node Q, the voltage at the node Q cannot immediately respond to the pull-down signal $Gn_2$. Discharging of the node Q can only begin after delay of a certain time interval.

Moreover, the transistor t411 corresponds to a resistor in series connection in the discharging path. Therefore, the voltage at the node Q cannot reach a preset final low electric potential (which is a power voltage Vss according to the present embodiment) after a first discharging procedure. In a first pull-down procedure, the voltage at the node Q is pulled down from a high electric potential to a voltage value that is higher than a preset low electric potential Vss, which corresponds to that the voltage of the node Q is pulled down to a first-step electric potential U1. That is, a first step is formed at a falling edge of the voltage of the node Q.

A second pull-down procedure of the voltage of the node Q is performed by the pull-down maintenance unit 24. As shown in FIG. 3, the pull-down maintenance unit 24 comprises a transistor t42 (a fifth transistor), a transistor t32 (a sixth transistor), a transistor t52 (a seventh transistor) and a transistor t51 (an eighth transistor). A source of the transistor t42 is connected to the constant low voltage signal Vss, and a drain of the transistor t42 is connected to the node Q. A gate and a source of the transistor t32 are respectively connected to a gate and a source of the transistor t42. A drain of the transistor t32 is connected to the row scan signal of the GOA drive unit to which the transistor t32 belongs, and is used for pulling down the row scan signal to a low electric potential in an appropriate time sequence. A gate of the transistor 52 is connected to the node Q. A source of the transistor 52 is connected to the constant low voltage signal Vss. A drain of the transistor t52 is connected to the gate of the transistor t42 (i.e., a node P). A gate and a drain of the transistor t51 are both connected to a constant high voltage signal LC (a third power signal). A source of the transistor t51 is connected to the gate of the transistor t42.

After the voltage at the node Q is pulled down to a first-step voltage U1 by the pull-down unit 23, the transistor t52 will be turned off. The transistor 51 can keep a voltage at the node P to be at a high electric potential, and maintains the transistor t42 to be in an on-state. Further, the voltage at node Q is pulled down for a second time by the transistor t42, and finally to a preset Vss. The power voltage Vss corresponds to a second-step voltage U2. Thus, a stepwise voltage with two steps is formed at the falling edge of the voltage of the node Q.

Besides, it should be noted that, a value of the first-step voltage U1 should be smaller than a value of a turn-on voltage of the transistor t52. When the first-step voltage U1 is determined by the transistor t411 which is formed as a diode, the above requirement can be met.

According to the embodiment of the present disclosure, through adding the transistor t411, a pull-down delay of the voltage at the node Q can be realized during a discharging procedure thereof, and further a gradual change of the voltage at the node Q can be realized.

Compared with the prior art, in the GOA drive circuit according to the embodiment of the present disclosure, a clock signal with a duty ratio of 0.5 can be used. That is, when a pulse width of the clock signal takes up a half of a clock signal cycle, the voltage at the node Q can be maintained stable. That is, the duty ratio of the clock signal does not need to be changed.

Specifically, in the prior art, in order to enable the voltage at the node Q to change smoothly so as to form a stepwise falling edge, a clock signal with a duty ratio of 0.4 is generally used to drive the GOA drive circuit. Consequently, when the clock signal with the duty ratio of 0.4 is used, a time for the GOA drive circuit to output an effective row scan signal is reduced, and further a time for charging pixel units will be reduced. If the time for charging pixel units fails to meet a preset requirement, a display effect of a liquid crystal display device will possibly be affected. According to the embodiment of the present disclosure, smoothness of the voltage at the node Q can be improved without reducing the time for charging pixel units.

In addition, the structure of the GOA drive circuit according to the embodiment of the present disclosure is simple, which is favorable for simplifying design thereof. As shown in FIG. 3, the pull-down signal $Gn_2$, which acts on gates of the transistor t31 and the transistor t41, can be connected in a manner corresponding to a transmission signal $STn_1$ which is connected to the gate of the transistor t11.

Specifically, when a transmission signal is output by a GOA drive unit in a previous stage which is in cascade connection to the GOA drive unit in the present stage, a row scan signal of a GOA drive unit in a next stage which is in cascade connection to the GOA drive unit in the present stage can be used as the pull-down signal. For example, if the GOA drive circuit is driven in an 8CK mode, a CK end is connected to CK1, CK3, CK5 and CK7 in sequence, and an XCK end is connected to CK2, CK4, CK6 and CK8 in sequence. Meanwhile, all GOA drive units are divided into four groups. A transmission signal of the GOA drive unit in an n stage is ST(n−4), and the pull-down signal thereof is ST(n+4). This is a symmetric design in the GOA drive circuit field, and design thereof can be simplified. There is no difficult of analyzing, and it is easy for implementation.

Although the embodiments of the present disclosure are provided as above, the above embodiments are described only for better understanding, rather than restricting the present disclosure. Anyone skilled in the art can make amendments to the implementing forms or details without departing from the spirit and scope of the present disclosure. The scope of the present disclosure should be subject to the scope defined in the claims.

The invention claimed is:

1. A GOA drive circuit, comprising multiple stages of GOA drive units, wherein a GOA drive unit in each stage is used for outputting a row scan signal to a row of pixel units and comprises a pull-up unit, a pull-up control unit which outputs a first voltage signal, a transmission unit, a pull-down unit, and a pull-down maintenance unit, wherein the pull-down unit is configured to increase a time for the first voltage signal to be pulled down to a first electric potential during a process when the first voltage signal jumps from a high electric potential to a low electric potential, so as to enable the first voltage signal to have a stepwise falling edge;

wherein a delay element is disposed on a path where the first voltage signal discharges by means of the pull-down unit;

the pull-down unit comprises a first transistor, with a gate thereof being connected to a pull-down signal, a drain thereof being connected to the first voltage signal, and a source thereof being connected to a first end of the delay element; and a second end of the delay element is connected to a first power signal.

2. The GOA drive circuit according to claim 1, wherein the pull-down unit further comprises a third transistor, with a gate thereof being connected to the pull-down signal, a drain thereof being connected to the row scan signal corresponding to the GOA drive unit to which the drain belongs, and a source thereof being connected to the first power signal.

3. The GOA drive circuit according to claim 1, wherein the pull-up control unit comprises a fourth transistor, with a gate thereof being connected to a transmission signal output by a transmission unit of a GOA drive unit in a previous stage in cascade connection with the GOA drive unit in a present stage, a source thereof being connected to the first voltage signal, and a drain thereof being connected to a second power signal.

4. The GOA drive circuit according to claim 1, wherein the pull-down maintenance unit comprises:

a fifth transistor, with a source thereof being connected to the first power signal and a drain thereof being connected to the first voltage signal;

a sixth transistor, with a gate and a source thereof respectively being connected to a gate and the source of the fifth transistor and a drain thereof being connected to the row scan signal corresponding to the GOA drive unit to which the drain belongs;

a seventh transistor, with a source thereof being connected to the first power signal, a gate thereof being connected to the first voltage signal, and a drain thereof being connected to the gate of the fifth transistor; and an eighth transistor, with a gate and a drain thereof being both connected to a third power signal, and a source thereof being connected to the gate of the fifth transistor.

5. The GOA drive circuit according to claim 1, wherein the pull-up unit comprises:

a ninth transistor, with a gate thereof being connected to the first voltage signal, a drain thereof being connected to a clock signal, and a source thereof being connected to the row scan signal corresponding to the GOA drive unit to which the source belongs; and a bootstrap capacitor, which is in parallel connection between the gate and the source of the ninth transistor.

6. The GOA drive circuit according to claim 5, wherein a duty ratio of the clock signal is 0.5.

7. The GOA drive circuit according to claim 1, wherein the pull-down signal comprises a row scan signal output by a GOA drive unit in a next stage in cascade connection with the GOA drive circuit in the present stage.

8. The GOA drive circuit according to claim 1, wherein the delay element comprises a second transistor, with a gate and a drain of thereof being both connected to the source of the first transistor, and a source thereof being connected to the first power signal.

9. The GOA drive circuit according to claim 8, wherein the pull-down unit further comprises a third transistor, with a gate thereof being connected to the pull-down signal, a drain thereof being connected to the row scan signal corresponding to the GOA drive unit to which the drain belongs, and a source thereof being connected to the first power signal.

10. The GOA drive circuit according to claim 8, wherein the pull-up control unit comprises a fourth transistor, with a gate thereof being connected to a transmission signal output by a transmission unit of a GOA drive unit in a previous stage in cascade connection with the GOA drive unit in a present stage, a source thereof being connected to the first voltage signal, and a drain thereof being connected to a second power signal.

11. The GOA drive circuit according to claim 8, wherein the pull-down maintenance unit comprises:

a fifth transistor, with a source thereof being connected to the first power signal and a drain thereof being connected to the first voltage signal;

a sixth transistor, with a gate and a source thereof being connected to a gate and the source of the fifth transistor and a drain thereof being connected to the row scan signal corresponding to the GOA drive unit to which the drain belongs;

a seventh transistor, with a source thereof being connected to the first power signal, a gate thereof being connected to the first voltage signal, and a drain thereof being connected to the gate of the fifth transistor; and an eighth transistor, with a gate and a drain thereof being both connected to a third power signal, and a source thereof being connected to the gate of the fifth transistor.

12. The GOA drive circuit according to claim 8, wherein the pull-up unit comprises:

a ninth transistor, with a gate thereof being connected to the first voltage signal, a drain thereof being connected to a clock signal, and a source thereof being connected to the row scan signal corresponding to the GOA drive unit to which the source belongs; and a bootstrap capacitor, which is in parallel connection between the gate and the source of the ninth transistor.

13. The GOA drive circuit according to claim 12, wherein a duty ratio of the clock signal is 0.5.

14. The GOA drive circuit according to claim 8, wherein the pull-down signal comprises a row scan signal output by a GOA drive unit in a next stage in cascade connection with the GOA drive circuit in the present stage.

* * * * *